US008512173B2

(12) United States Patent
Winningham et al.

(10) Patent No.: US 8,512,173 B2
(45) **Date of Patent: *Aug. 20, 2013**

(54) LACROSSE HEAD

(75) Inventors: Matthew M. Winningham, Royal Oak, MI (US); Joshua G. Schmidt, Royal Oak, MI (US)

(73) Assignee: Warrior Sports, Inc., Warren, MI (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/607,265

(22) Filed: Sep. 7, 2012

(65) Prior Publication Data

US 2013/0005517 A1 Jan. 3, 2013

Related U.S. Application Data

(63) Continuation of application No. 12/710,875, filed on Feb. 23, 2010, now Pat. No. 8,282,512.

(60) Provisional application No. 61/163,691, filed on Mar. 26, 2009.

(51) Int. Cl.
*A63B 59/02* (2006.01)
*A63B 65/12* (2006.01)

(52) U.S. Cl.
USPC ..... 473/513; D21/724

(58) Field of Classification Search
USPC ..... 473/505, 512, 513; D21/724
See application file for complete search history.

(56) References Cited

U.S. PATENT DOCUMENTS

| | | | |
|---|---|---|---|
| 236,045 | A | 12/1880 | Kreutzer |
| 1,555,164 | A | 9/1925 | Schwartz |
| 1,611,858 | A | 12/1926 | Middlekauff |
| 1,633,614 | A | 6/1927 | Sibbald et al. |
| 1,750,644 | A | 3/1930 | Norton |
| 2,274,788 | A | 3/1942 | Hatton |
| 2,902,072 | A | 7/1958 | Reuter |

(Continued)

FOREIGN PATENT DOCUMENTS

| | | |
|---|---|---|
| GB | 0424742 | 2/1935 |
| JP | 2000-61005 | 2/2000 |

OTHER PUBLICATIONS

Web page download, Devco Design and Development, 1998, http://devco-design.com/mi-mold.htm, 3pp.

(Continued)

*Primary Examiner* — Gene Kim
*Assistant Examiner* — M Chambers
(74) *Attorney, Agent, or Firm* — Warner Norcross & Judd LLP

(57) ABSTRACT

A lacrosse head including a spine element that is at least partially embedded or encapsulated in a base and sidewalls of the lacrosse head. The spine element can terminate short of a scoop of the lacrosse head. Where the lacrosse sidewalls are of an open frame construction and include a non-string hole, the spine element can define a spine element hole that is aligned with the non-string hole. The spine element can also include a transverse element that spans from an upper rail to a lower rail of the sidewalls adjacent a cross member of the sidewalls. The base and sidewalls can include viewing apertures through which some of the spine element can be viewed, while other parts of the spine element remain concealed. The spine element can be constructed from one plastic, while the remainder of the head can be constructed from a different plastic.

20 Claims, 6 Drawing Sheets

(56) References Cited

U.S. PATENT DOCUMENTS

| | | | | |
|---|---|---|---|---|
| 3,402,385 | A | 9/1968 | Feinberg | |
| 3,479,030 | A | 11/1969 | Merola | |
| 3,701,374 | A | 10/1972 | McGillvary | |
| 3,910,578 | A | 10/1975 | Brine, Jr. | |
| D248,679 | S | 7/1978 | Rule | |
| 4,098,508 | A | 7/1978 | Gandy | |
| 4,119,313 | A | 10/1978 | Popplewell et al. | |
| 4,129,635 | A | 12/1978 | Yasuike et al. | |
| 4,310,368 | A | 1/1982 | Urquiaga | |
| D263,249 | S | 3/1982 | Rule | |
| D265,845 | S | 8/1982 | Brine, Jr. et al. | |
| 4,374,590 | A | 2/1983 | Everlith et al. | |
| D277,691 | S | 2/1985 | Rule | |
| D286,666 | S | 11/1986 | Brine, Jr. | |
| D286,803 | S | 11/1986 | Brine, Jr. | |
| 4,683,784 | A | 8/1987 | Lamont | |
| 4,830,812 | A | 5/1989 | Kauer | |
| 5,028,377 | A | 7/1991 | Hendry | |
| 5,048,843 | A | 9/1991 | Dorfi et al. | |
| 5,054,790 | A | 10/1991 | Brine et al. | |
| 5,075,056 | A | 12/1991 | Umlauft et al. | |
| 5,118,455 | A | 6/1992 | Loren | |
| 5,261,665 | A | 11/1993 | Downey | |
| 5,421,574 | A | 6/1995 | Yamagishi et al. | |
| 5,470,649 | A | 11/1995 | Farley | |
| 5,494,297 | A | 2/1996 | MacNeil | |
| 5,551,690 | A | 9/1996 | Brown | |
| 5,565,514 | A * | 10/1996 | Carlberg | 524/494 |
| 5,568,925 | A | 10/1996 | Morrow et al. | |
| D376,183 | S | 12/1996 | Morrow et al. | |
| 5,651,549 | A | 7/1997 | Dill et al. | |
| 5,662,484 | A | 9/1997 | Blanche | |
| 5,685,791 | A | 11/1997 | Feeney | |
| 5,935,026 | A | 8/1999 | Dill et al. | |
| 5,957,791 | A | 9/1999 | Nichols et al. | |
| 5,965,622 | A | 10/1999 | Senanayake | |
| 5,967,912 | A | 10/1999 | Hexemer et al. | |
| 6,066,056 | A | 5/2000 | Morrow | |
| 6,190,212 | B1 | 2/2001 | Brown et al. | |
| 6,213,901 | B1 | 4/2001 | Collinson | |
| 6,439,074 | B1 | 8/2002 | Stencel | |
| 6,561,932 | B2 | 5/2003 | Morrow et al. | |
| RE38,216 | E | 8/2003 | Morrow et al. | |
| 6,676,547 | B1 | 1/2004 | Morrow et al. | |
| 6,723,134 | B2 | 4/2004 | Tucker, Sr. | |
| 6,852,047 | B2 | 2/2005 | Tucker, Sr. | |
| 6,902,501 | B2 | 6/2005 | Morrow et al. | |
| 6,916,259 | B2 | 7/2005 | Kohler et al. | |
| 6,921,347 | B1 | 7/2005 | Morrow et al. | |
| 6,926,628 | B2 | 8/2005 | Morrow et al. | |
| 6,929,572 | B2 | 8/2005 | Morrow et al. | |
| 6,976,701 | B2 | 12/2005 | Gray et al. | |
| 6,994,640 | B2 | 2/2006 | Morrow et al. | |
| 7,101,294 | B2 | 9/2006 | Tucker, Sr. | |
| 7,131,919 | B2 | 11/2006 | Kohler et al. | |
| 7,226,374 | B2 * | 6/2007 | Morrow et al. | 473/513 |
| 7,238,128 | B1 | 7/2007 | Filice et al. | |
| 7,258,634 | B2 | 8/2007 | Morrow et al. | |
| 7,264,562 | B2 | 9/2007 | Morrow et al. | |
| RE40,182 | E | 3/2008 | Morrow | |
| 7,357,739 | B2 | 4/2008 | Montano et al. | |
| 7,547,261 | B2 | 6/2009 | Morrow et al. | |
| 7,563,184 | B2 | 7/2009 | Morrow et al. | |
| D598,508 | S | 8/2009 | Schmidt | |
| D598,509 | S | 8/2009 | Winningham | |
| D599,420 | S | 9/2009 | Winningham | |
| D599,866 | S | 9/2009 | Winningham | |
| D601,212 | S | 9/2009 | Winningham | |
| 7,591,744 | B2 | 9/2009 | Morrow et al. | |
| D601,646 | S | 10/2009 | Schmidt | |
| D601,647 | S | 10/2009 | Winningham | |
| 7,618,335 | B2 | 11/2009 | Brown et al. | |
| 7,736,251 | B2 | 6/2010 | Rogers et al. | |
| 8,282,512 | B1 * | 10/2012 | Winningham et al. | 473/513 |
| 2002/0098924 | A1 | 7/2002 | Houser et al. | |
| 2004/0072637 | A1 | 4/2004 | Morrow et al. | |
| 2005/0215359 | A1 | 9/2005 | Gait | |
| 2006/0019777 | A1 | 1/2006 | Rogers et al. | |
| 2006/0276274 | A1 | 12/2006 | Tucker, Sr. | |
| 2007/0270254 | A1 | 11/2007 | Morrow et al. | |
| 2007/0270255 | A1 | 11/2007 | Morrow et al. | |
| 2008/0026884 | A1 * | 1/2008 | Morrow et al. | 473/513 |
| 2009/0062041 | A1 | 3/2009 | Tucker, Sr. et al. | |
| 2010/0000656 | A1 | 1/2010 | Winningham et al. | |
| 2013/0005517 | A1 * | 1/2013 | Winningham et al. | 473/513 |

OTHER PUBLICATIONS

Web page download, Plastics Technology, Apr. 5, 2006, www.plasticstechnology.com/articles/article_print1.cfm, 2 pp.

Web page download, Nitrojection, Apr. 5, 2006, www.nitrojection.com, 4 pp.

Web page download, Bayer, Apr. 5, 2006, www.bayerone.com, 6 pp.

* cited by examiner

LACROSSE HEAD

BACKGROUND OF THE INVENTION

The present invention relates to a lacrosse head for attachment to a lacrosse handle, and more particularly, to a lacrosse head including a spine element that enhances the stability, durability and deflection properties of the head.

Conventional lacrosse heads typically include an open frame having a ball stop joined with the base, a pair of sidewalls that diverge from the ball stop, and a scoop that connects the sidewalls, opposite the ball stop. The sidewalls generally include a lower portion, such as a lower rim, that defines multiple circular or elliptical string holes. A lacrosse net is strung to the lower rim via the string holes, around the back side of the frame, leaving the opposing side of the frame open for catching or shooting a lacrosse ball.

Many heads are configured to improve the overall strength of the heads so that they can withstand the rigors of a lacrosse game. One head that has impressive strength, and yet remains light and easily handled, is the Stiffi® head which is manufactured by a major lacrosse manufacturer, Warrior Sports, Inc. of Warren Mich. Several embodiments of the Stiffi® are disclosed in U.S. Pat. Nos. 7,258,634 and 7,226,374, which are hereby incorporated by reference. In very general terms, the commercially available Stiffi® head is reinforced is by including lightweight, cylindrical titanium rods in the upper rails of the sidewalls. While this well-received construction provides excellent reinforcement and strength to the lacrosse head, the placement of the rods within the head is complicated, and requires sophisticated and precise molds and molding techniques.

SUMMARY OF THE INVENTION

The present invention provides a lacrosse head including a spine element that provides exceptional structural support and strength to a lacrosse head.

In one embodiment, the lacrosse head includes sidewalls of an open frame construction and including at least one non-string hole. The spine element can be a rigid structure that is at least partially embedded, encapsulated and/or molded in the sidewalls. The spine element can define a spine element hole that is aligned with the non-string hole to maintain the open frame construction of the sidewall while improving strength.

In another embodiment, the spine element can be at least partially embedded, encapsulated and/or molded in a ball stop and/or base of the head. The spine element can include a spine base from which upper and lower elements extend, generally toward a scoop of the lacrosse head. Optionally, the upper and lower elements, and the spine element terminate short of the scoop. Further optionally, the upper and lower elements can be embedded, encapsulated and/or molded in upper and lower rails of the sidewalls.

In yet another embodiment, the spine element can include a transverse element that is joined with and extends between the upper and lower elements. The transverse element can be at least partially embedded, encapsulated and/or molded in a cross member of the sidewall that connects the upper and lower rails of the sidewall. Optionally, the transverse element or the cross member can define a groove, with the other of the transverse element or the cross member including a ridge or other projection. The ridge or other projection can be positioned within the groove so that the transverse member and the cross member are structurally and physically interlocked together to prevent relative movement between these components in the finished head.

In still another embodiment, the sidewalls, base or other portion of the head can be of a first color, and the spine element can be of a second color. The sidewall, base or other portion of the head can define view holes which offer a view of the spine element embedded, encapsulated and/or molded in the head. Optionally, the spine element can be of a second different color so that a viewer can readily perceive that the lacrosse head includes a spine element embedded therein.

In a further embodiment, the base, scoop and sidewalls of the head can be constructed from a first plastic, such as a polyamide. The spine element can be constructed from a second plastic, such as another polyamide, that is different from the first polyamide. Optionally, the second plastic can be un-reinforced, that is, it can be void of strands, fibers or other reinforcing structures. Further optionally, the first plastic can be unreinforced as well, with the only reinforcing structure being the spine element.

In still a further embodiment, the first plastic can be a nylon 6,6 polyamide, suitable for injection molding, such as Zytel® ST801 available from E.I. du Pont de Nemours and Company. The second plastic can be a high performance polyamide resin, also suitable for injection molding, and in particular, a polyamide that is more rigid, yet more brittle than the first plastic.

In yet a further embodiment, the spine element can include a spine base that is embedded, encapsulated and/or molded in the base of the lacrosse head at a ball stop of the head. The spine base can include a region bounded by a periphery. That region can be visible in the finished head. The periphery can also be immediately adjacent and bounded by a portion of the base and/or sidewall of the lacrosse head.

In another, further embodiment, the spine element can include regions of different thickness. For example, the spine base can be of a first thickness and the spine region can be of a second thickness that is greater than the first thickness. The first thickness can transition to the second thickness at or near the periphery of the spine base region.

The lacrosse head described herein provides exceptional structural support and strength via the spine element incorporated into the head. Where the spine element is made from a different plastic from the remainder of the head, the head can be of light weight, but still provide enhanced durability and resistance to breakage when subjected to impacts during a lacrosse game or otherwise. The head also exhibits improved deflection characteristics comparable to conventional titanium reinforced heads. Where the components of the head define apertures through which the spine element can be viewed, the head is readily identified as being reinforced with the spine element by observers. This effect can be enhanced where the color of the spine element differs from the color of the remainder of the head.

These and other objects, advantages, and features of the invention will be more fully understood and appreciated by reference to the description of the current embodiment and the drawings.

DESCRIPTION OF THE CURRENT EMBODIMENT

I. Overview

Figure 1:
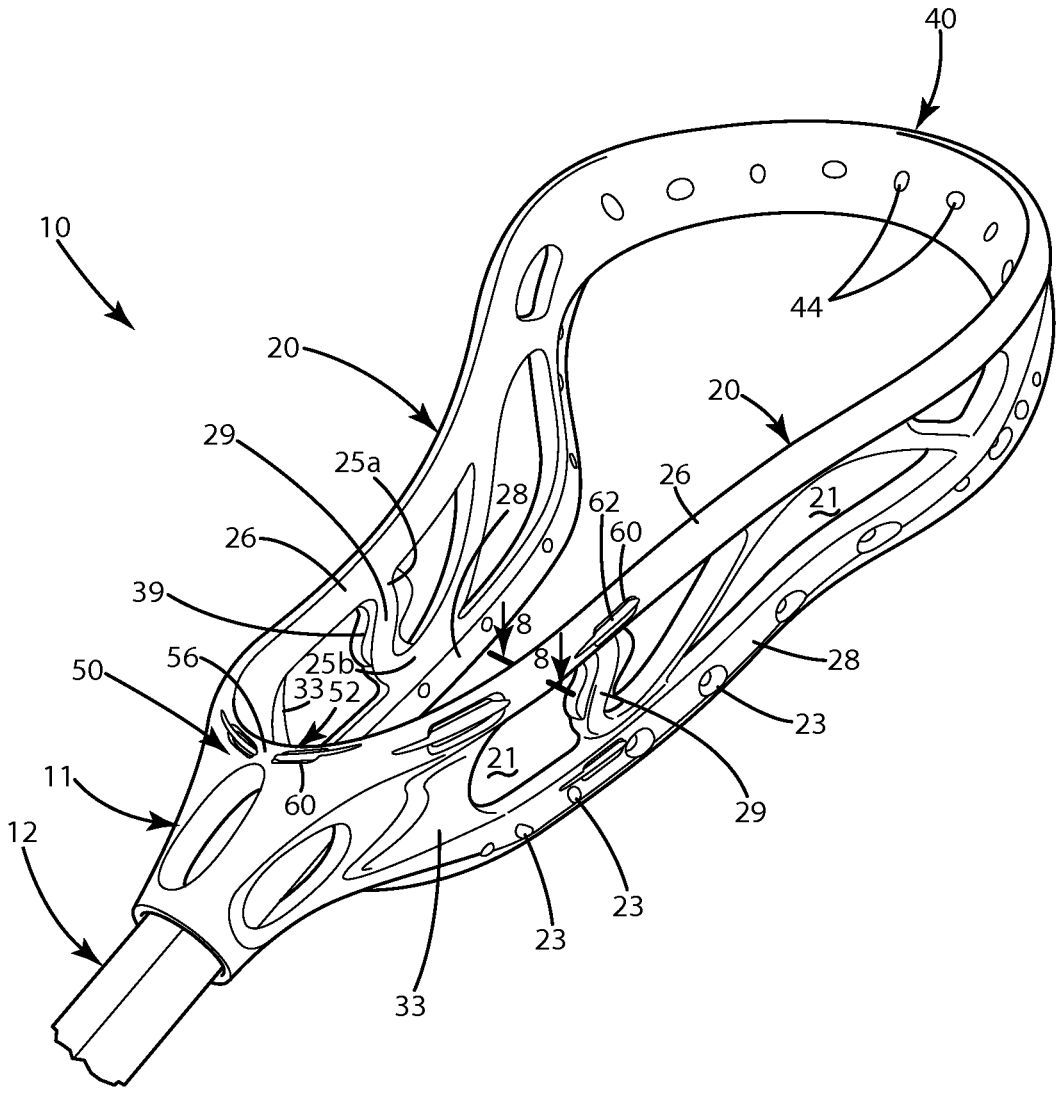
FIG. 1 is a perspective view of a current embodiment of a lacrosse head.

A current embodiment of the lacrosse head of the present invention is shown in FIGS. 1-5 and generally designated 10. The lacrosse head 10 includes a throat 11 adapted to connect to a lacrosse handle 12, a pair of opposing sidewalls 20 and a scoop 40 connecting the pair of opposing sidewalls 20 opposite the throat 11. Located at the lower end of the head, adjacent the throat 11, is a base 50 which includes a ball stop 52. The sidewalls 20 can sidewall be of an open frame construction, that is, they can define at least one non-string hole that is adapted to reduce the weight of the head, such as the frame hole 21. Each sidewall can also include an upper rail 26 and a lower rail 28 separated from one another by a distance. A cross member 29 can be joined with the upper rail 26 and the lower rail 28.

Figure 2:
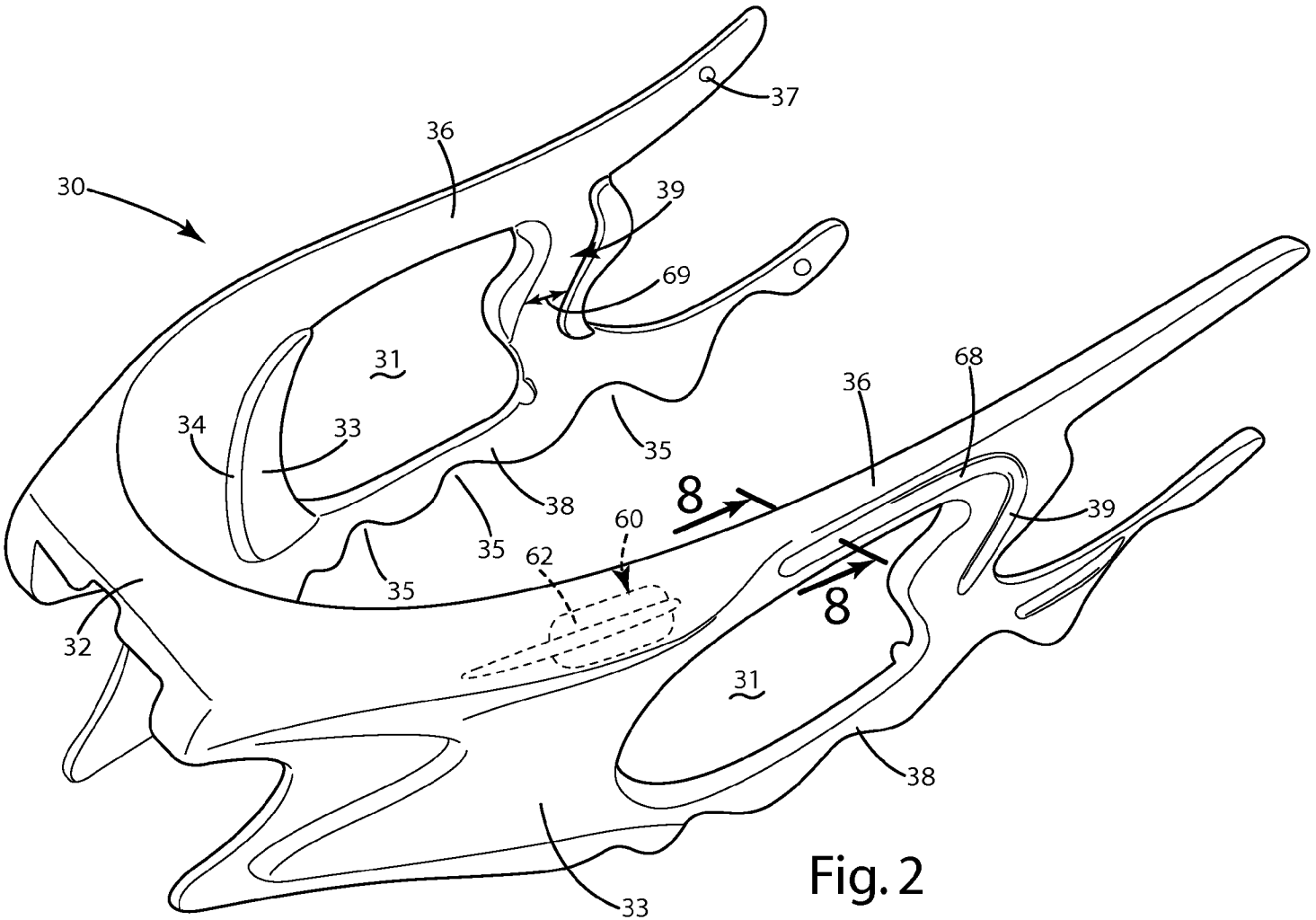
FIG. 2 is a first perspective view of a spine element of the lacrosse head.
Figure 4:
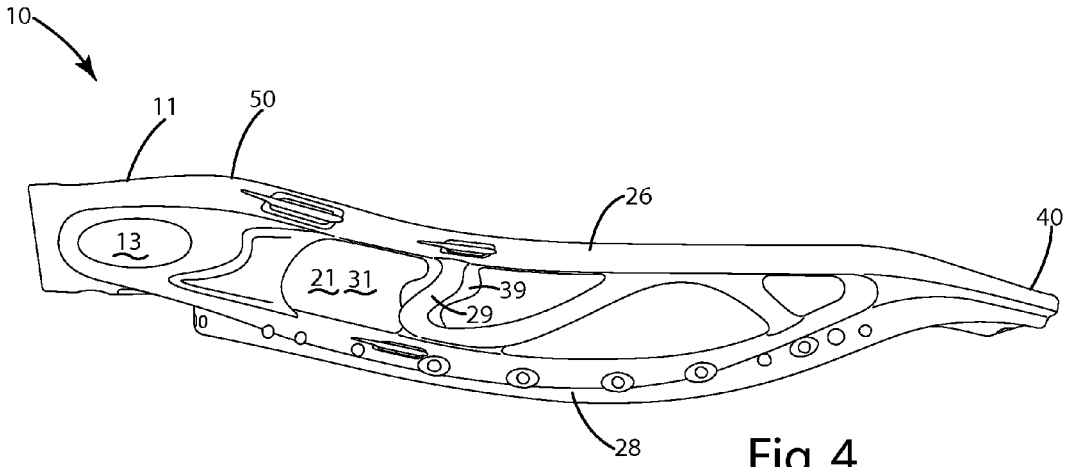
FIG. 4 is a side view of the lacrosse head.

The lacrosse head 10 further includes a rigid spine element 30, which is embedded, encapsulated and/or integrally molded in the head. As used herein, the phrase "embedded in" refers to any one or more of the conditions where an element is embedded in, encapsulated in, and/or integrally molded in the head or another structure. The spine element 30 can be at least partially concealed in any one or more of the base 50, the upper rail 26, the lower rail 28 or the cross member 29 of the sidewalls. The spine element can define a spine element hole 31 that is at least partially aligned with a non-string hole 21 of the sidewalls 20 (FIGS. 2, 4). The spine element can be constructed from a second plastic that is more rigid and brittle than the plastic from which the remainder of the head is constructed. The spine element can provide enhanced rigidity and reduced deflection of the head when sideways forces are exerted on the head as described below. Further, due to the lightweight construction of the plastic of the spine element, a significant weight savings for the head can be achieved. Each of the above structures will now be described in further detail.

II. Construction

As depicted in FIG. 2, the throat 11 can extend from the base 50, and can define a socket 13. The socket 13 can be tubular in shape and can define a cavity to receive a handle 12. Alternatively, the throat 11 can include a projection which is adapted to fit within a handle. The handle 12 can be secured within the socket 13, optionally by a fastener (not shown), such as a screw, peg, or other fastening devices or materials such as adhesives. Optionally, the socket 13 can define apertures or holes (not shown) to reduce the weight of the head.

Figure 5:
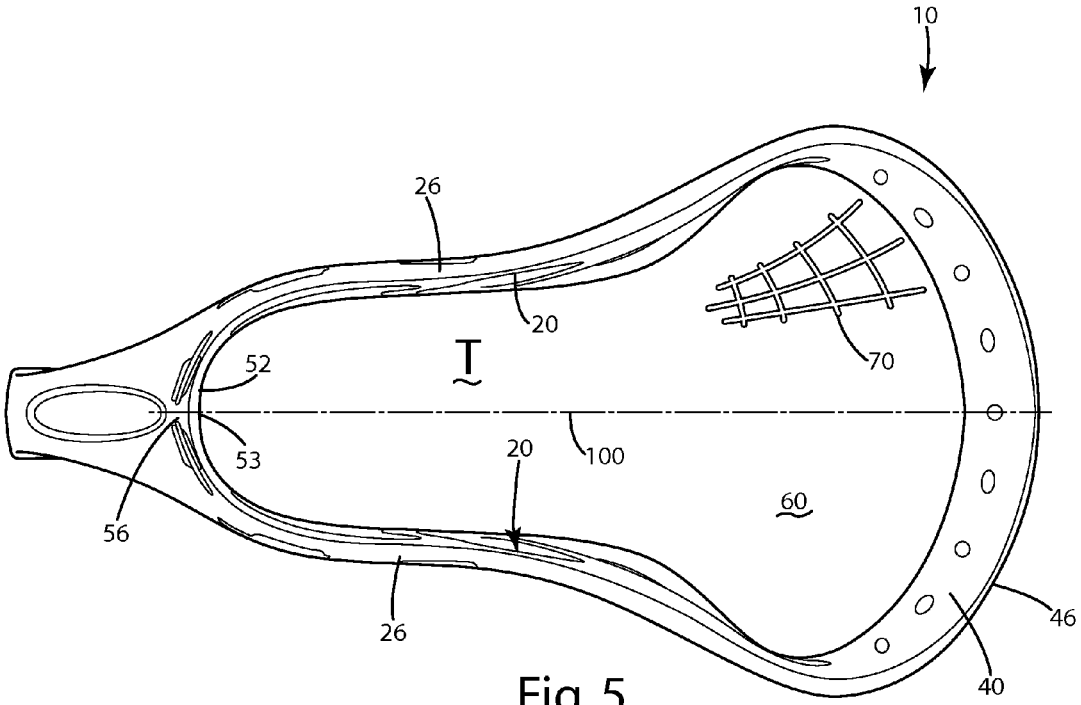
FIG. 5 is a top view of the lacrosse head.
Figure 6:
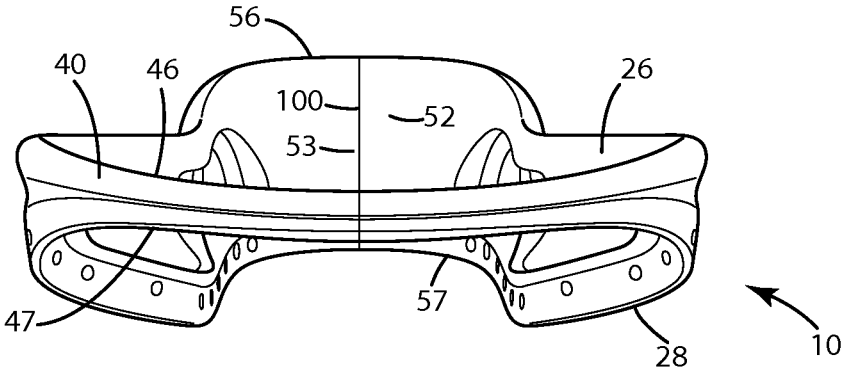
FIG. 6 is a front view of the lacrosse head with the spine element in phantom.
Figure 7:
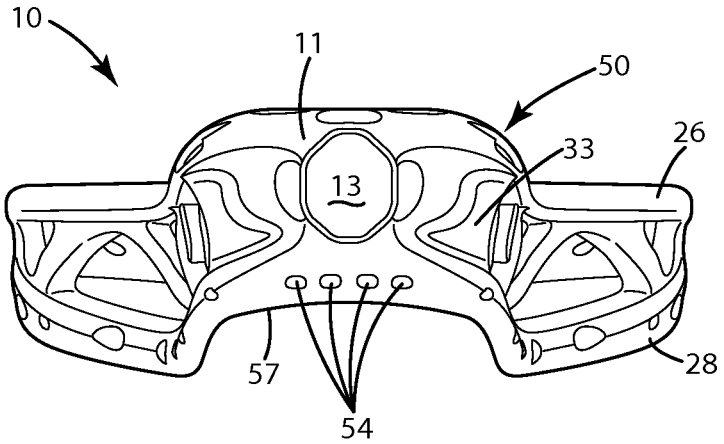
FIG. 7 is a rear view of the lacrosse head with the spine element in phantom.

As shown in FIGS. 1, 5 and 6, the head 10 can include a pair of sidewalls 20. These sidewalls can be positioned on opposite sides of a longitudinal axis 100 of the head, which can generally bisect the head in opposing halves. The longitudinal axis 100 can pass directly through the middle portion 53 of the ball stop 52 as described in further detail below. One or both of the sidewalls 20 can extend generally from the ball stop 52 toward the scoop 40, which is located at the opposite end of the head 10.

Each sidewall can include upper rails 26 and lower rails 28. These rails can be secured to and extend between the base 50 and the scoop 40. Alternatively, these upper and lower rails can be an extension of the base 50. Referring to FIG. 5, the upper rails 26 can follow an outward curvilinear path near the base 50 before extending generally parallel to the central longitudinal axis 100 along a portion of its length, generally within the throat T of the head. The throat T can generally extend from the ball stop 50 to ½ to ⅔ the length of the ball receiving area 60 of the head, or other distance as desired. Optionally, the upper and lower rails can be of a circular, polygonal, elliptical, rectangular, or beveled cross-sections that are generally uniform that or vary as these elements extend from the base 50 to the scoop 40.

As shown in FIGS. 1 and 4, the sidewalls can be of an open frame construction, defining one or more non-string apertures 21 between the upper and lower rails. These apertures can be of any preselected shape, and can be configured for structural or aesthetic purposes as desired. In addition to the non-string holes, the sidewalls and other portions of the head optionally can include multiple string holes, such as the ball stop holes 54 and the scoop holes 44 that allow attachment of a net 70 to the head 10. The precise placement of these string holes can vary as desired.

The sidewalls 20, and particularly the upper rails 26 can join with an upper rim 56 of the ball stop 50, as well as an upper ball stop rim 46 of the scoop 40. This bounded region can generally define a ball receiving area 60, which is where a lacrosse ball can enter or exit the head 10 when the ball is caught, thrown, shot or dislodged. Opposite the ball receiving area, the sidewall lower rim 28, scoop lower rim 47 and lower ball stop rim 57 can also define a lower bounded region, which can define a ball retaining area. This is where a lacrosse ball typically is located when retained in the head 10 and more particularly in the net 70 attached to the head 10.

As shown in FIGS. 1 and 4, the sidewalls can also include a cross member 29 that generally extends between and is joined with the upper rail 26 and the lower rail 28. The cross member can include a first end 25*a* that joins the upper rail 26 and a second end 25*b* that joins the lower rail 28. Optionally, these first and second ends can be located anywhere along the upper and lower respective rails, and joined with those rails along the lengths of those components as desired. Further optionally, the cross member 29 can be curved as illustrated, or linear, extending at virtually any angle relative to the upper and lower rails.

Referring to FIGS. 1-4, the lacrosse head 10 can include a spine element 30 which generally includes upper 36 and lower 38 elements extending from a spine base 32 which generally corresponds to the lacrosse head base 50. The spine base 32 can further include transverse elements 39 which are positioned adjacent and/or embedded within the cross members 29 of the sidewalls. The spine element 30 can further define a spine hole 31 that is generally aligned with the non-string hole 21 of the sidewall so that a complete through hole is formed through the side hole in the region of the spine hole 31. With the construction of the spine element, enhanced durability and structural rigidity is provided to the head, generally in the throat T region of the head where significant stresses particularly lateral deflection and vibrations are typically exerted and/or focused. The spine element provides surprising and unexpected results by structurally strengthening the head 10, despite the fact that the spine element is constructed from a substantially more brittle material than the remainder of the head. Moreover, despite the inclusion of an optional spine hole 31 in the spine element 30, it continues to provide surprising deflection resistance to sideways forces typically exerted on lacrosse heads in play.

Referring to FIGS. 1 and 2, the spine element 30 is at least partially embedded in the ball stop 52 and a first and second sidewalls 20 of the head, but terminates short of the scoop 40. In general, the spine element can be disposed and extend from the base 50, and in particular, the ball stop 52 forwardly within the throat T. The spine base 32 can be configured in the same general geometric shape as the ball stop 52 so that when the spine element is embedded in the ball stop 52, it is generally hidden from view in that region.

Figure 8:
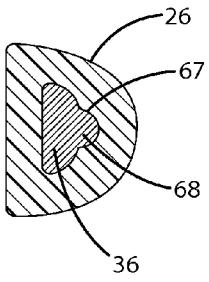
FIG. 8 is a sectional view taken along line 8-8 of FIG. 1.

From the spine base 32, upper elements 36 of the spine extend generally forwardly toward the scoop 40. These upper elements 36, also referred to as the first and second upper elements, can be generally elongated bar-like structures of a solid core construction, that is, being generally solid without substantial voids within the structure itself, as can be the remaining pieces of the spine element as desired. The upper elements 36 may or may not take on the same cross section as the upper rails 26 within which they are embedded. For example, the side elements may be of an elliptical cross section, while the upper rails 26 may include a flat inner surface which faces the pocket, but a rounded outer surface that faces away from the pocket of the ball receiving area 60. One example of the optional cross sections of the rails is illustrated in FIG. 8 and described in detail below.

The upper elements 36 each can include an insert hole 37 that is adapted to interfit with a peg or other structure in a mold to facilitate placement of the spine element 30 within the mold before the plastic material that forms the remaining sidewalls base, scoop and other components of the lacrosse head are injected into the mold. Generally, these insert holes 37 face inward toward the ball receiving area 60 and can be cleanly ground down should material abnormally form around these elements in the finished lacrosse head 10.

The upper elements 36, also referred to as the first and second upper elements, can be separated a pre-selected distance from the first and second lower elements 38 as desired. Generally, this distance can correspond to the distance separating the upper rail 26 and the lower rail 28 of the finished sidewall so that the upper and lower elements remain generally embedded within or at least partially embedded within those upper and lower rails.

As shown in FIG. 2, the lower element 38 can also extend from the spine base 32 forwardly toward the scoop 40. The first and second lower elements 38 can generally be of the same structure and cross section as the upper elements 36 described above. Optionally, the lower elements 36 can include recesses 35. These recesses 35 can be aligned with and generally border the string holes 23 in the lower rail 28 of the sidewalls 20. In some cases, given the brittleness of the spine element 30, it has been discovered that drilling string holes through the lower element 38—rather than using the recesses 35 as shown—can, in some limited circumstances, decrease the strength and rigidity provided by the spine element. Of course, by varying the thickness of the spine element and/or adding special re-enforcing features, these recesses 35 may optionally be replaced with through holes that align with the string holes 23 of the lower rails 28. Toward the end of the lower elements 38, additional mold-peg holes can be included such as those described above in connection with the upper elements 36.

In general, at least a portion, if not a majority of the upper and lower elements can be embedded in the upper rail and lower rail of the head respectively. Likewise, with the exception of the spine base region 34, when included, at least a portion, if not a majority, of the spine base 32 can be embedded and concealed from view in the base 50, and in particular, the ball stop 52 of the lacrosse head. This provides an opportunity to employ contrasting materials to draw attention to the inclusion of the spine element 30. The material from which the spine element 30 is constructed can be of a certain color plastic, for example, blue. The remainder of the head in which the spine element 30 is embedded can be constructed of a second plastic material of a second color, for example, white. Thus, with reference to FIGS. 1, and 2, in such a construction, the head may be perceived by a viewer as including a spine element or a different structure within the material of the remainder of the head simply by viewing the spine base region 34, and/or the overlapping spine element materials of the transverse member 39, which extend beyond and are visible within the cross member 29. This added enhancement can provide aesthetic appeal that confirm that the head includes the spine element 30 for a potential consumer.

In addition, if desired as shown in FIG. 1, the lacrosse head 10 can define rail holes 60 in the upper 26 or lower 28 rail of the sidewalls 20 as desired. With these rail holes, the spine element 30 is embedded within those upper and lower rails can be viewed. For example, the portion 62 of the spine element 30 can be viewable through the rail holes 60 as illustrated in FIG. 2. As desired, these rail holes 60 can be located anywhere on the head, and can be defined by any element within which the spine element 30 is embedded. For example, in the top the base 50 as shown in FIG. 1, additional rail holes 60 can be defined with at least a portion of the spine base 32 being viewable through those holes. This added viewability of the spine element 30 can confirm for a potential consumer that the head indeed includes the unique spine element 30.

As shown in FIGS. 1-4, in general, the spine base 32 extends vertically, adjacent the upper ball stop rim 56 to adjacent the lower ball stop rim 57. If desired, the spine element can actually define these upper and lower ball stop rails. However, in the current embodiment illustrated, the spine element terminates adjacent these rails so as to remain concealed or at least partially embedded within the base 50.

Returning to FIGS. 2 and 3, the spine element 30 can include spine base regions 34. The spine base region can be generally bounded by spine base region peripheries 33. In the finished lacrosse head, the first spine base region 34 can be exposed for viewing by a viewer, at least on the exterior of the head. These spine base regions 34 can optionally provide increased deflection resistance and strength to the spine base, particularly immediately adjacent the spine holes 31. At least a portion of the spine base region 34 can be immediately adjacent and bounded by the material that forms the remainder of the sidewalls 20.

Figure 3:
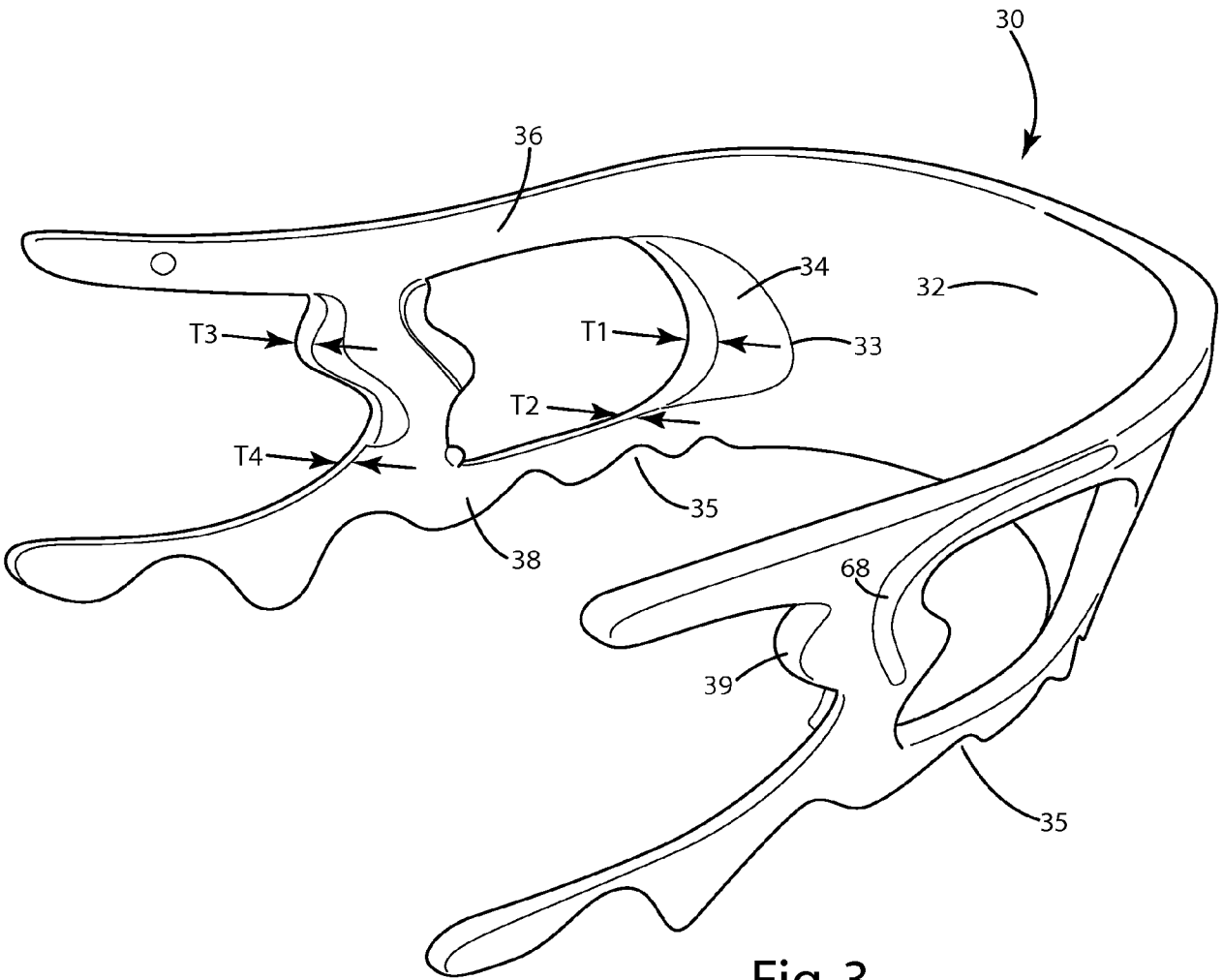
FIG. 3 is a second perspective view of the spine element.

As illustrated in FIG. 3, the spine element 30, and particularly spine base region 34, can vary in thickness. As shown there, the thickness of the spine base region 34 can be of a thickness T1, whereas the thickness of the remainder of the spine base 32 immediately adjacent the spine base region 34 can be of a thickness T2. The thickness T1 can be greater than T2 by a magnitude of 1, 2, 3, 4, 5, 6 or any other magnitude as desired. Similarly, the remaining thickness T2 can be built up by the material that forms the sidewalls 20 and ball stop 52 of the remaining portion of the lacrosse head so that the exterior surface of the spine base region 34 is flush with the inner surface of the ball stop 52. In general, the first thickness T1 transitions to the second thickness T2 at the spine base periphery 33. The transition can be gradual or abrupt as illustrated. As shown in FIG. 1, the spine base region 34 can be fully visible within the sidewall 20. It is generally not concealed, as are many of the other components of the spine base 30.

Returning to FIGS. 2 and 3, the spine element 30 as mentioned above can include transverse elements 39 that are joined with the upper element 36 and lower element 38 on the respective sides of the spine element 30. The transverse element also can extend between the upper rail 26 and lower rail 28 of the sidewalls 20. This transverse element 39 can be at least partially embedded and optionally concealed in the cross member 29 of the sidewalls 20. Multiple transverse elements can be included in the spine element with corresponding cross members of the sidewalls in a similar manner.

With reference to FIGS. 1 and 2, the transverse element 39 can define a groove 69. In the assembled, fully constructed lacrosse head 10 as illustrated in FIG. 1, the cross member 29 of the sidewall 20 can be positioned at least partially within the groove extending from the upper rail 26 to the lower rail 28. The groove can be less than the length of the entire transverse element 39. As further shown in the rightmost sidewall of FIG. 1, opposite the groove 69 of the transverse element 30, on the exterior of the sidewall 20, the cross member 29 can be externally placed relative to the remainder of the transverse element, thereby at least partially embedding that transverse element within the cross member 29. Optionally, with the groove construction noted above, the transverse member and the cross member can be physically interlocked together, which can reduce and/or eliminate relative movement between these components on the finished lacrosse head. This can be beneficial where the materials forming the spine element and the remainder of the head do not readily cross link and bind to one another.

The transverse element can also be of varying thickness. As shown in FIG. 3, an upper portion may be of thickness T3, while the lower portion may be of thickness T4. Where the thicknesses of the transverse element 39 vary like this, the thickness of the cross member 29 may correspondingly vary. For example, the cross member 29 near the thickness T4 can be thicker so that the inner surface of the cross member is flush with the remainder of the transverse member as desired.

Optionally, the various components of the spine element 30, for example the upper rail 36 and the transverse element 39 and/or the lower element 38 can include a ridge 68 that interfits within a recess 67 to provide further physical interlocking between the spine element 30 and the remainder of the head 10. For example, as shown in FIGS. 2, 3 and 8, the recess 67 can be defined in an upper rail 26 of the sidewall 20. The upper element 36 of the spine element 30 can include a ridge or projection 68 that interfits and is located within the recess 68 to provide a physical interlocking between these elements to prevent relative movement therebetween. Optionally, the recess and projection can be reversed. For example, the spine element 30 can define a recess, and the component within which the spine element 30 is embedded can form a projection or ridge that interfits within the recess to physically lock the components together if desired. Moreover, the projection need not be a continuous ridge 68 as illustrated in FIGS. 2-3. Instead, the ridge can be intermittently spaced ridges, or simple posts that extend outwardly from the spine element 30. Alternatively, the spine element 30 can define multiple holes within which the material that forms the remainder of the lacrosse head fill to provide additional interlocking. Whatever structure optionally used to provide further interlocking between the spine element and the remainder of the head, that structure may be concealed from view of a viewer as desired.

The materials used to construct the spine element and the remainder of the lacrosse head can widely vary. Generally, such materials can include nylon, urethane, polycarbonate, polyethylene, polypropylene, polyketone, polybutylene terephalate or optionally, any of a variety of polyamides. Both the spine element and the remaining components of the head 10 can be constructed from the same material, for example, one of the above materials, or the spine element can be constructed from a different material from the remaining components of the head. For example, in the current embodiment, the head components, excluding the spine element, can be constructed from a first plastic, such as a polyamide, and the spine element can be constructed from a second plastic that is different from the first polyamide, such as another polyamide.

In one embodiment, the first plastic from which the throat, base, scoop and sidewalls are constructed can be a nylon 6,6 polyamide. Such a polyamide can be relatively resilient and not prone to breakage upon deflection, e.g., not very brittle. The first plastic also can have certain material properties. For example, Relative Humidity (RH) and/or Dry As Molded (DAM) the first plastic can optionally have a mechanical property of at least 40% elongation at break, and optionally greater than or equal to 50% elongation at break as measured under ISO 527 testing techniques and measured at 50% Relative Humidity (RH) and/or Dry As Molded (DAM). The first plastic also can have a Tensile Modulus of 230 ksi to 250 ksi, optionally 246 ksi at 32° F. when measured at 50% RH under ISO 527 testing techniques. When measured DAM using ISO 527 testing techniques, the first plastic can have a Tensile Modulus of about 300 ksi to 320 ksi, and optionally 315 ksi when measured at 32° F.

The Flexural Modulus of the first plastic can be in a range of about 190 ksi to 200 ksi at 50% RH using ISO 178 testing techniques at a temperature of 32° F. Optionally the Flexural Modulus measured under ISO 178 testing techniques DAM can exhibit about 270 ksi to 280 ksi, optionally 276 ksi at a temperature of 32° F.

The first plastic can also exhibit an Izod Impact, Notched test material property, as measured under ISO 180/1A testing techniques of about 34 ft-lb/in$^2$ to about 35 ft-lb/in$^2$, and optionally 34.7 ft-lb/in$^2$ measured DAM, and further optionally 44 ft-lb/in$^2$ at 50% RH.

A suitable material for use as the first plastic in the components of the lacrosse head 10, other than the spine element, is offered under the trade name Zytel® ST801, which is available from E.I. du Pont de Nemours and Company of Wilmington, Del.

The material from which the spine element is constructed, that is, the second plastic, can be different from the first plastic. The second plastic can be a homogenous plastic that is void of fibers, strands and reinforcement structures. In general, the first spine element can be constructed from an unreinforced polyamide, for example, a high performance polyamide that can be adapted for injection molding, and more specifically, a polypthalamide (PPA) that is optionally heat stabilized. The material can exhibit a Tensile Modulus of about 300 to about 330 ksi, optionally about 320 ksi measured DAM using ISO 527 testing techniques. The Flexural Modulus of this material can be about 300 to 340 ksi, optionally about 330 ksi measured at 50% RH using the ISO 527 testing techniques. Further optionally, the Flexural Modulus can be about 280 to about 320 ksi, optionally 290 ksi measured DAM. One suitable, exemplary material for use as the second plastic is offered under the trade name Zytel® FE8200, which is also available from E.I. du Pont de Nemours and Company.

In general, the second plastic can be somewhat brittle, which can be generally characterized as a mechanical property where the material does not exhibit much elongation before or at breaking. For example, the second plastic can have an elongation at break as measured under ISO 527 testing techniques of about 5% to about 20%, and optionally about 10% at a 50% RH. When measured DAM, the material can exhibit a 10% to about 20%, optionally about 15% elongation at break. With the second material being relatively ungiving and somewhat brittle, its inclusion in the current embodiment is surprising. For example, instead of breaking upon impact and/or breaking when embedded or encapsulated within the first plastic, it maintains its structure without breaking or cracking when subjected to impacts and loads normally encountered in a lacrosse game. Further, contrary to conventional thought, the combination of the first plastic and the second plastic in one embodiment yields a lacrosse head that need not be reinforced by any metal structure, yet exhibits strengths that were met or surpassed conventional titanium reinforced heads. These surprising results are illustrated in the example below:

Example 1

In this example, which is provided simply for illustrative purposes and not intended to be limiting, a lacrosse head of the current embodiment was tested against: (a) an identically configured lacrosse head, not including the spine element, and instead constructed from a single plastic material, namely du Pont's ST801A; and (b) a titanium-reinforced lacrosse head including a comparable geometry to that of the current embodiment, and commercially available under the trade name Stiffi® Ti, from Warrior Sports, Inc. of Warren, Mich.

Figure 9:
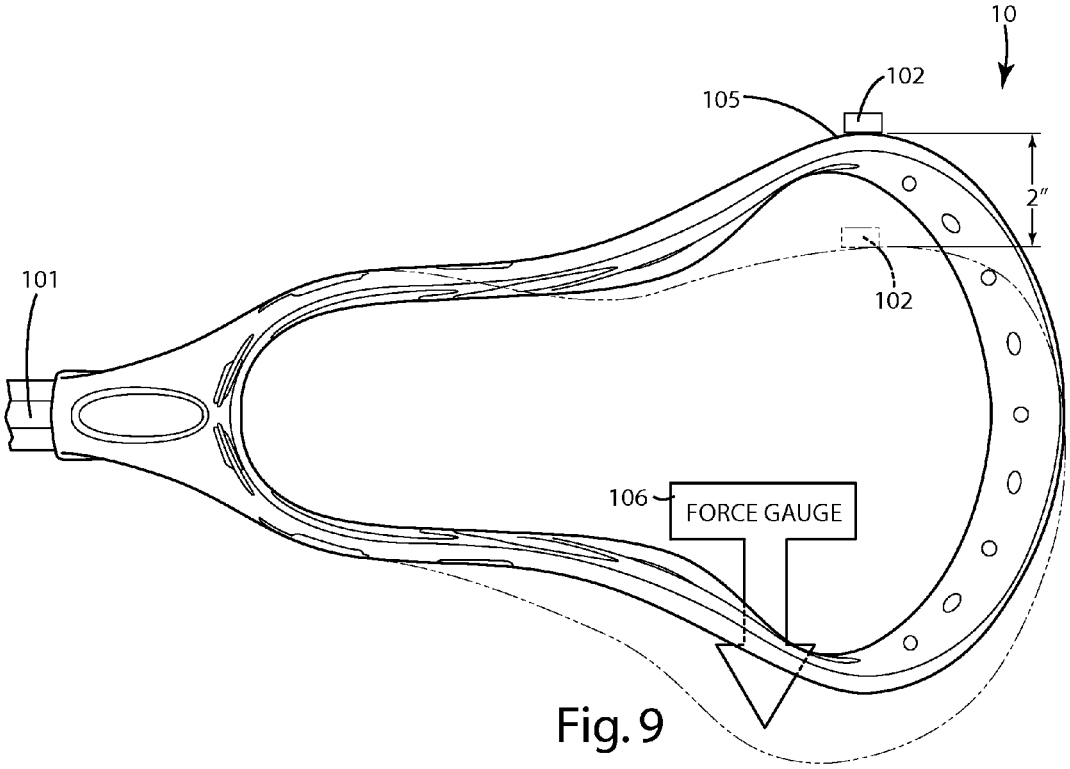
FIG. 9 is an illustration of a deflection test conducted in Example 1.

The unexpected and surprising results of the testing illustrate that a lacrosse head reinforced with the spine element of the current embodiment exhibited exceptional strength and countered deflection of the head similar to that typically encountered in a lacrosse game. As illustrated in FIG. 9, each of the tested lacrosse heads were set-up on a fixture 101. The fixture oriented the heads in a generally sideways configuration. A height gauge 102 was zeroed on the top edge 105 of each head as illustrated. The height gauge was calibrated so that it could measure a 2 inch deflection of the head as illustrated in phantom lines. The head was deflected using a force gauge hooked into the uppermost string hole of the respective heads until the top edge 105 was even with the lowered height gauge denoting a 2 inch deflection at the illustrated location of the head. The forces in pounds required to achieve the noted 2 inch deflection was recorded from the force gauge for each head.

In this example, a comparison was conducted between three heads. The first head was a RazorPro 2.0 constructed from ST801 and in the form shown generally in FIG. 1 (but without a spine element 30). This "normal" RazorPro 2.0 required 17.6 pounds of force to deflect 2 inches. The next head tested was a RazorPro 2.0 prototype internally reinforced with the spine element illustrated in FIGS. 2 and 3. The spine element was constructed from a second plastic, normally the high performance, rigid yet somewhat brittle PPA as described above. The remainder of the head was constructed of ST801. The result of that test was that 22.9 pounds of force was required to deflect the head 2 inches. This illustrated a 30% improvement over the regular unreinforced RazorPro 2.0. This 30% improvement over the regular unreinforced RazorPro 2.0 was unexpected and surprising.

Even more surprising was the added structural strength of this head compared well to a conventional titanium (i.e., metal) reinforced head, specifically, the Stiffi® Ti lacrosse head. Upon testing the Stiffi® head, 22.4 pounds of force were required to deflect the head 2 inches, or about a half a pound less than the head reinforced with the spine element described above. The previous thought was that the only way to achieve such impressive reduction in deflection due to excessive forces was to reinforce the heads with metal—not a relatively brittle plastic structure. Thus, the results of the testing of this example were surprising.

To manufacture the lacrosse head 10 of the present invention, the spine element as illustrated in FIGS. 2 and 3 is first molded from the high performance polyamide or other suitable plastic to form the various components thereof. After this spine element is pre-molded, it is positioned in a mold and locked in place using mold pegs that interfit with the pegs 37 as described above to hold the spine element in a predetermined location within the head mold cavity. The head mold cavity is then injected with another different plastic material, such as ST801 to form the remaining components of the lacrosse head 10 such as the sidewall scoop and base. Optionally, where the spine element is constructed from a different plastic from the remainder of the head, such as that discussed above, i.e. high performance polyamide, the spine element retains its general structure and shape, that is, it is not consumed within the plastic of the remainder of the head. For example, the plastic of the spine element does not melt but instead is simply encapsulated or embedded at least partially in the head. Many portions of the insert as described above are embedded and encapsulated within and integrally molded within the other components with the finished lacrosse head. With the lacrosse head molded, it is allowed to cure for a predetermined amount of time and then removed from the lacrosse head mold for finishing operations.

The above description is that of the current embodiment of the invention. Various alterations and changes can be made without departing from the spirit and broader aspects of the invention as defined in the appended claims, which are to be interpreted in accordance with the principles of patent law including the doctrine of equivalents. Any reference to claim elements in the singular, for example, using the articles "a," "an," "the" or "said," is not to be construed as limiting the element to the singular.

The invention claimed is:

1. A lacrosse head comprising:

a throat adapted to connect to a lacrosse handle;

a base joined with the throat, the base including a ball stop, the ball stop extending from an upper ball stop rim to a lower ball stop rim;

a scoop distal from the base;

a first sidewall and a second sidewall, each extending from the base toward the scoop and joined with one another distal from the base at the scoop, each first and second sidewall being of an open frame construction and defining a non-string hole, each first and second sidewall including an upper rail and a lower rail, and a cross member extending between and joined with the upper rail and the lower rail, a spine element at least partially embedded in the ball stop, the first sidewall and the second sidewall, the spine element including a spine base from which a first upper element and a second upper element, and a first lower element and a second lower element, extend forwardly toward but terminate short of the scoop, wherein the first upper element and the second upper element are at least partially embedded and concealed in the upper rails of the respective first and second sidewalls respectively, wherein the first lower element and the second lower element are at least partially embedded and concealed in the lower rails of the first and second sidewalls respectively, wherein the spine element includes a first transverse element that is joined with the first upper element and the first lower element forward of the ball stop, wherein the first transverse element extends between the upper rail and lower rail of the first sidewall, and is at least partially embedded and concealed in the cross member of the first sidewall, wherein the spine element includes a second transverse element that is joined with the second upper element and the second lower element forward of the ball stop, wherein the second transverse element extends between the upper rail and lower rail of the second sidewall, and is at least partially embedded and concealed in the cross member of the second sidewall, wherein at least one of the first transverse element, the first lower element, and the first upper element of the spine element is exposed and visible to a viewer of the lacrosse head first sidewall, wherein at least one of the second transverse element, the second lower element, and the second upper element of the spine element is exposed and visible to a viewer of the lacrosse head second sidewall, wherein the spine element includes a spine base extending within the base, wherein the spine base includes a spine base region that extends from the upper rail to the lower rail, rearward of the first and second transverse elements, wherein the spine base region provides deflection resistance and strength to the spine base, wherein the spine base extends through the ball stop from one side of the head to the other, connecting the first upper element, second upper element, first lower element and second lower element, wherein the spine base is of a first thickness and the spine base region is of a second thickness that is greater than the first thickness to provide further strength to the spine.

2. The lacrosse head of claim 1, wherein the spine element defines a first spine hole that is aligned with the non-string hole of the first sidewall, wherein the spine element includes a spine base extending within the base, and wherein the spine base includes a spine base region that is immediately adjacent the first spine hole, rearward of the first spine hole, wherein the spine base region provides deflection resistance and strength to the spine base.

3. The lacrosse head of claim 2 wherein the spine base is of a first thickness and the spine base region is of a second thickness that is greater than the first thickness.

4. The lacrosse head of claim 2 wherein the first spine hole is bounded by the spine base, the first upper element, the first transverse element, and the first lower element of the spine element.

5. The lacrosse head of claim 1 wherein the lower rails define a plurality of string holes, wherein the plurality of string holes are defined below the first and second lower elements of the spine elements without extending through the first and second lower elements.

6. The lacrosse head of claim 1 wherein the at least one of the upper rails and the lower rails are of a first color and the at least one of the first upper element, the second upper element, the first lower element and second lower element, is of a second, different color, whereby a viewer of the lacrosse head can readily perceive that the lacrosse head includes a spine element at least partially embedded within at least a portion of the first and second sidewalls by viewing the color differentiation between the first and second colors.

7. The lacrosse head of claim 1, wherein the spine element defines a first spine hole that is aligned with the non-string hole of the first sidewall, wherein the spine hole is encircled by the spine base, the first upper element, the transverse element and the first lower element of the first sidewall.

8. A lacrosse head comprising:

a throat adapted to connect to a lacrosse handle;

a base joined with the throat;

a scoop distal from the base;

a pair of sidewalls extending from the base and joined with one another distal from the base at the scoop, each sidewall being of an open frame construction and including at least one non-string hole, each sidewall including an upper rail and a lower rail separated from one another by a distance, each sidewall including a cross member joined with the upper rail and the lower rail; and a rigid, pre-molded spine element at least partially embedded in the base, the upper rail and the lower rail and the cross member of each of the pair of sidewalls, wherein the spine element defines a spine element hole that is at least partially aligned with the non-string hole of the open frame construction, so that a hole extends completely through the spine element and the open frame construction, wherein the spine element includes an upper element that extends along and is at least partially encapsulated by the upper rail, wherein the spine element includes a lower element that extends along and is at least partially encapsulated by the lower rail, wherein the lower element includes a lower surface, wherein the lower rail defines a plurality of string holes located adjacent but below the lower surface of the lower element within the lower rail, wherein at least one of the upper element and the lower element of the spine element is exposed and visible to a viewer of at least one of the pair of sidewalls.

9. The lacrosse head of claim 8 wherein the spine element includes a spine base region, the spine base being of a first thickness and the spine base region being of a second thickness that is greater than the first thickness.

10. The lacrosse head of claim 9 wherein the spine element includes a spine transverse element that is interlocked with and generally parallel to the cross member.

11. The lacrosse head of claim 8 wherein the lower element terminates in the lower rail at a lower element free end, and wherein the upper element terminates in the upper rail at an upper element free end that is distal from the lower element free end.

12. The lacrosse head of claim 11, wherein the base, scoop and pair of sidewalls are constructed from a first polyamide, wherein the spine element is constructed from a second polyamide that is different from the first polyamide, wherein the second polyamide is void of any reinforcing strands, reinforcing fibers or reinforcing structures, and wherein the first polyamide is void of any reinforcing strands, reinforcing fibers or reinforcing structures except for the spine element.

13. The lacrosse head of claim 8 wherein the lower surface of the lower element of the spine element defines a plurality of recesses, the recesses generally aligned with and bordering the plurality of string holes, without the string holes extending through the lower element of the spine element.

14. The lacrosse head of claim 8, wherein the spine element includes a spine base extending at least partially within the base, and wherein the spine base includes a spine base region that is immediately adjacent the spine element hole, rearward of the hole, the spine base region providing deflection resistance and strength to the spine base.

15. The lacrosse head of claim 8 wherein the base, scoop and pair of sidewalls are constructed from a nylon-6,6 polyamide, and wherein the spine element is constructed from a polypthalamide.

16. A lacrosse head comprising:

a throat adapted to connect to a lacrosse handle;

a base joined with the throat, the base including a ball stop, the ball stop extending from an upper ball stop rim to a lower ball stop rim;

a scoop distal from the base;

a pair of sidewalls extending from the base and joined with one another distal from the base at the scoop, each sidewall being of an open frame construction and including at least one non-string hole, the pair of sidewalls, base and scoop formed from a first plastic material; and a spine element at least partially molded into and encapsulated by the base and the pair of sidewalls, the spine element formed from a second plastic material different from the first plastic material, wherein each of the sidewalls includes an upper rail and a lower rail joined by a cross member, wherein the spine element includes an upper element that extends along and is at least partially encapsulated by the upper rail, wherein the spine element includes a lower element that extends along and is at least partially encapsulated by the lower rail, wherein the spine element includes a transverse member that extends from and joins the upper element and the lower element of the spine element, wherein the transverse member of the spine element is immediately adjacent the cross member, wherein the cross member defines a groove, the groove extending generally from adjacent the upper rail toward the lower rail of the spine element, wherein the transverse member of the spine element is positioned in the groove defined by the cross member, and extends generally parallel to the cross member, wherein at least one of the transverse member, the upper element and the lower element of the spine element is exposed and visible to a viewer of at least one of the pair of sidewalls.

17. The lacrosse head of claim 16, wherein the spine element extends from the upper ball stop rim to the lower ball stop rim, and around a substantial portion of the ball stop, wherein the lower element of the spine element extends forward from the ball stop, wherein the lower element of the spine element transitions to a spine base region that extends rearward from the ball stop.

18. The lacrosse head of claim 17 wherein the spine base region is partially exposed through the base, and partially concealed by the base when the lacrosse head is viewed from a side view.

19. The lacrosse head of claim 16, wherein the transverse element is visible in the finished lacrosse head in the groove, wherein the cross member includes an inner surface facing a pocket area of the head, wherein the transverse element includes an exposed surface that is flush with the inner surface of the cross member facing the pocket area.

20. The lacrosse head of claim 16, wherein the first plastic is a nylon-6,6 polyamide, and wherein the second plastic is a heat stabilized polypthalamide, wherein the first plastic has the mechanical property of at least 40% elongation at break, and wherein the second plastic has the material property of about 5% to about 15% elongation at break.

* * * * *